United States Patent [19]

Tipton

[11] Patent Number: 4,938,882

[45] Date of Patent: Jul. 3, 1990

[54] BORATED AND NON-BORATED OVERBASED CARBOXYLATES AS CORROSION INHIBITORS

[75] Inventor: Craig D. Tipton, Perry, Ohio

[73] Assignee: The Lubrizol Corporation, Wickliffe, Ohio

[21] Appl. No.: 408,432

[22] Filed: Sep. 15, 1989

Related U.S. Application Data

[63] Continuation of Ser. No. 179,087, Apr. 8, 1988, abandoned.

[51] Int. Cl.[5] ..... C10M 159/20

[52] U.S. Cl. ..... 252/38; 252/39; 252/41; 252/45

[58] Field of Search ..... 252/39, 38, 45, 41

[56] References Cited

U.S. PATENT DOCUMENTS

| | | | |
|---|---|---|---|
| 3,595,790 | 7/1971 | Norman et al. | 252/32.7 |
| 3,629,109 | 12/1971 | Gergel et al. | 252/39 |
| 3,899,432 | 8/1975 | Rothert et al. | 252/32.7 |
| 3,929,650 | 12/1975 | King et al. | 252/33.4 |
| 4,089,790 | 5/1978 | Adams | 252/25 |
| 4,119,549 | 10/1978 | Davis | 252/45 |
| 4,163,729 | 8/1979 | Adams | 252/25 |
| 4,171,268 | 10/1979 | Collins | 252/32.7 |
| 4,253,976 | 3/1981 | Forsberg | 252/39 |
| 4,283,294 | 8/1981 | Clarke | 252/32.7 |
| 4,505,830 | 3/1985 | Vinci | 252/33 |
| 4,560,488 | 12/1985 | Vinci | 252/33 |

FOREIGN PATENT DOCUMENTS

| | | | |
|---|---|---|---|
| 2459387 | 6/1975 | Fed. Rep. of Germany | 252/39 |
| 8701723 | 3/1987 | PCT Int'l Appl. . | |
| 8706256 | 10/1987 | PCT Int'l Appl. . | |
| 1121713 | 7/1968 | United Kingdom . | |

*Primary Examiner*—William R. Dixon, Jr.
*Assistant Examiner*—Jerry D. Johnson
*Attorney, Agent, or Firm*—Forrest L. Collins; Frederick D. Hunter; Robert A. Franks

[57] ABSTRACT

A corrosion inhibitor additive for gear oil formulations is disclosed in the form of an overbased carboxylate which can be in a borated or non-borated form. Borated versions of the overbased carboxylate are preferred and are obtained by reacting a boron reactant such as boric acid with an overbased carboxylate. The overbased carboxylate in its borated and non-borated forms has been found to be effective in improving the corrosion inhibiting properties of gear oil formulations which are used under severe operating conditions wherein the gear oil might come into contact with contaminant water. A method of improving the corrosion resistance of a gear oil having contaminant water therein is also disclosed.

18 Claims, No Drawings

BORATED AND NON-BORATED OVERBASED CARBOXYLATES AS CORROSION INHIBITORS

This is a continuation of co-pending application Ser. No. 179,087 filed on Apr. 8, 1988, now abandoned.

CROSS REFERENCE

This application claims subject matter related, in part, to the disclosure of pending U.S. application Ser. No. 047,754 filed May 7, 1987, of which application I am the inventor. The disclosure of the earlier filed application Ser. No. 047,754 is incorporated herein by reference and priority to this earlier application is claimed to the extent possible under 35 USC Section 120.

FIELD OF THE INVENTION

This invention relates generally to the field of additives which are included within lubricant compositions in order to improve performance characteristics of the lubricants. More specifically, the invention relates to additive compounds which act as corrosion inhibitors within gear oil compositions, the corrosion inhibitors being in the form of borated and non-borated forms of overbased carboxylates.

BACKGROUND OF THE INVENTION

The ability to inhibit corrosion, rust formation, oxidation and deterioration is a very significant property of lubricating compositions and functional fluids. The significance of such properties becomes increasingly important when the lubricant or functional fluid is used in connection with very expensive equipment under severe operating conditions. The significance of the ability to inhibit corrosion is further emphasized when the lubricant, such as a gear oil, is used in an environment such that it comes into contact with water under extreme temperature and pressure conditions. In the absence of a corrosion inhibitor with high performance characteristics the useful life of the machinery will be substantially reduced. Accordingly, many manufacturers of equipment requiring the use of functional fluids and lubricants require that such fluids and lubricants contain corrosion inhibitors. A number of tests have been devised in order to rate the corrosion inhibiting properties of lubricants and functional fluids when used under extreme conditions. Accordingly, there is a significant need for corrosion inhibitors which can be easily and economically manufactured and provided in lubricants and functional fluids in order to provide corrosion inhibiting properties.

U.S. Pat. No. 3,929,650 to King et al discloses a particulate dispersion of an alkali metal borate. The borate is prepared by contacting boric acid with an alkali metal carbonate overbased metal sulfonate within an oleophilic liquid reaction medium. The reactants are contacted at a temperature in the range of 20°-200° C. for a period of 0.5-7 hours with the molar ratio of the boric acid to the alkaline metal carbonate being in the range of from 1-3.

U.S. Pat. No. 3,595,790 to Norman et al discloses a number of different oil soluble highly basic metal salts of various organic acids. Salts of sulfonic acids, carboxylic acids and phosphorus acids are obtained by reacting such acids with an excess amount of a metal base in the presence of an acidic gas such as carbon dioxide and a promoter such as alcohol under substantially anhydrous conditions. The basic metal salts are indicated as being useful as additives in crankcase oils (oils of low viscosity compared to gear oils) in order to neutralize undesirable acid bodies formed in crankcase oils during engine operation.

SUMMARY OF THE INVENTION

The present invention is a corrosion inhibitor additive compound which is used in connection with lubricants in the form of gear oils. The corrosion inhibitor additive is in the form of an overbased carboxylate which is preferably borated. The borated versions of the overbased carboxylate additive of the invention are most generally prepared by reacting a boron reactant (preferably boric acid) with an overbased carboxylate. The invention also relates to a method of improving the corrosion inhibiting properties of a gear oil comprising adding borated and/or non-borated versions of the corrosion inhibitor of the invention to the gear oil which contains small amounts (0.1% to 5% based on the weight of the gear oil) of contaminant water, and allowing the corrosion inhibitor to disperse in the system and thereby improve overall corrosion inhibiting properties.

An object of the present invention is to provide a corrosion inhibitor useful in a wide range of lubricating and functional fluid compositions and particularly in gear oils.

An advantage of the present invention is that the overbased carboxylate composition of the invention can be easily and economically manufactured and included within lubricating compositions in the form of gear oils to inhibit corrosion, rust formation, oxidation and deterioration.

A feature of the present invention is that the corrosion inhibitor additive can be provided in a variety of overbased carboxylate forms. More specifically, the carboxylate acid anion portion as well as the metal cation portion of the molecule are readily available and economical as is the optional borating agent.

Another advantage of the corrosion inhibitor composition is that it can provide corrosion resistance properties to a gear oil while not acting in a manner which is antagonistic with respect to high speed score and shock loading protection which antagonistic properties are generally obtained by the use of free carboxylic acids, another well known class of corrosion inhibitors.

Yet another advantage of the present invention is that the corrosion inhibitors provide improved properties to gear oils without having a undesirable effect on the oxidation and/or thermal stability of the gear oils, which undesirable effects are obtained when utilizing amine compounds as corrosion inhibitors.

These and other objects, advantages and features of the present invention will become apparent to those persons skilled in the art upon reading the details of formulation, synthesis and usage as more fully set forth below. Reference being made to the accompanying general structural formulae forming a part hereof wherein like symbols refer to like molecular moieties throughout.

DETAILED DESCRIPTION OF PREFERRED EMBODIMENTS

Before the present corrosion inhibitor additive, process for making such additive, oil formulations, method for improving corrosion, and additive concentrates are described it is to be understood that this invention is not limited to the particular chemical compounds processes, formulations, methods, or concentrates described as such compounds, processes, formulations and concentrates, may, of course, vary. It is also to be understood that the terminology used herein is for the purpose of describing particular embodiments only, and is not intended to be limiting since the scope of the present invention will be limited only by the appended claims.

It must be noted that as used in this specification and the appended claims, the singular forms "a", "an" and "the" include plural referents unless the context clearly dictated otherwise. Thus, for example, reference to "an overbased carboxylate," includes mixtures of such carboxylates, reference to "a corrosion inhibitor" includes reference to mixtures of such corrosion inhibitors and reference to "oils" includes mixtures of such oils and so forth.

The present invention provides a corrosion inhibitor additive which can be used in connection with lubricants and functional fluids. The additive is in the form of an overbased carboxylate which can be in a borated or non-borated form. It is pointed out that the borated versions are generally preferred, and are prepared by reacting a boron reactant (preferably boric acid) with an overbased carboxylate. Overbased carboxylates are known to be used in crankcase engine oils (oils of low viscosity compared to gear oils) in order to neutralize acidic components formed during engine operation. These acidic components are formed by "engine blow back" a phenomenon which does not occur in a rear axle assembly.

In connection with the present disclosure, the term "overbased" or "overbased compound" or "overbased carboxylate" is generally used to designate metal salts wherein the metal ion is present in stoichiometrically larger amounts than the organic acid radical. The commonly employed methods for preparing overbased compounds involve heating a mineral oil solution of an acid (such as a carboxylic acid) with a stoichiometric excess of a metal neutralizing agent such as the metal oxide, hydroxide, carbonate, bicarbonate, or sulfide at a temperature above 50° C. and filtering the resulting mass.

In connection with the production of overbased compounds it is generally preferred to use a promoter in a neutralization step in order to aid in the incorporation of a large excess of metal. A particularly effective method of preparing an overbased carboxylate comprises mixing a carboxylic acid with a stoichiometric excess of a basic alkaline earth neutralizing agent such as calcium hydroxide and at least one alcohol promoter and carbonating the mixture by passing $CO_2$ into the mixture at an elevated temperature which may be in the range of 10° C. to 200° C. but is more preferably in the range of about 40° to 80° C.

The present inventor has found that the corrosion inhibiting properties of various lubricating compositions and functional fluids, specifically gear oil formulations, can be greatly improved by including an additive in the form of an overbased carboxylate which is preferably borated. Such an overbased carboxylate is prepared by reacting a stoichiometric excess of a metal neutralizing agent with a statistical mixture of carboxylic acids to form a statistical mixture of carboxylates which includes a stoichiometric excess of the metal. The anion portion of the present corrosion inhibitor is an ionized carboxylic acid or ionized carboxylate and is most preferably a statistical mixture of such. A statistical mixture of components is a mixture consisting of a large number of compounds which differ, one from the other, in small increments (e.g. molecular weight and shape) over a wide range. The cationic portion of the present corrosion inhibitor is typically an ion of an alkali metal or an ion of an alkaline earth metal. Some specific metals which might be utilized include lithium, potassium, sodium, magnesium, calcium and barium with sodium, calcium and magnesium being preferred.

A number of different types of carboxylic acids may be used individually or preferably in statistical mixtures in producing the present invention. Useful carboxylic acids include oleic acids, tall oil acids, pumitic acids, linoleic acids, stearic acids and lauric acids. Other carboxylic acids which are oil soluble or dispersible in a salt form combination with other additives within lubricants of functional fluids can also be used in connection with the present invention. Useful carboxylic acids generally contain 12 to 22 carbon atoms.

The carboxylic acid component is converted to a salt by reacting it with a metal neutralizing agent. The neutralizing agent may be a metal by itself of a metal oxide, hydroxide, carbonate, bicarbonate or sulfide. Such neutralizing agents may be used individually or preferably in combination with each other in a statistical mixture. Sodium, calcium and magnesium metals and metal compounds are preferably used in connection with the present invention. However, other alkali and alkaline earth metals and compounds thereof may be used in connection with producing the overbased carboxylates of the invention.

The overbased carboxylates of the present invention can be obtained by reacting one or more of the carboxylic acids or statistical mixtures thereof indicated above with one or more of the neutralizing agents indicated above. The neutralizing agents are to be added in stoichiometrically larger amounts than the organic acid. Means of carrying out the reaction between the organic acid and the neutralizing agent have been indicated above. A typical reaction might involve the reaction of calcium hydroxide and oleic acid in order to form a calcium carboxylate, more specifically, calcium oleate.

Such a reaction product could be referred to by the following general empirical formula (I):

$$Ca(RCOO)_2 \cdot XCa(OH)_2 \cdot YCaCO_3$$

wherein R is a hydrocarbyl and X and Y combined are greater than one and vary depending on the degree of overbasing desire. A range of different "R's" are present in a preferred statistical mixture of the invention.

In formula (I) and elsewhere in the disclosure hydrocarbyl means "hydrocarbon-based." As used herein, the term "hydrocarbon-based," "hydrocarbon-based substituent" and the like denotes a substituent having a carbon directly attached to the remainder of the molecule and having predominantly hydrocarbyl character within the context of this invention.

Examples of hydrocarbyl substituents which might be useful in connection with the present invention include the following:

(1) hydrocarbon substituents, that is, aliphatic (e.g., alkyl or alkenyl), alicyclic (e.g., cycloalkyl, cycloalkenyl) substituents, aromatic, aliphatic and alicyclic-substituted aromatic nuclei and the like as well as cyclic substituents wherein the ring is completed through another portion of the molecule (that is, for example, any two indicated substituents may together form an alicyclic radical);

(2) substituted hydrocarbon substituents, that is, those substituents containing nonhydrocarbon radicals which, in the context of this invention, do not alter the predominantly hydrocarbon substituent; those skilled in the art will be aware of such radicals (e.g., halo (especially chloro and fluoro), alkoxy, mercapto, alkylmercapto, nitro, nitroso, sulfoxy, etc.);

(3) hereto substituents, that is, substituents which will, while having predominantly hydrocarbyl character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furanyl, thiophenyl, imidazolyl, etc., are exemplary of these hereto substituents heteroatoms and preferably no more than one, will be present for each ten carbon atoms in the hydrocarbon-based substituents. Typically, there will be no such radicals or heteroatoms in the hydrocarbon-based substituent and it will, therefore, by purely hydrocarbon.

Some preferred carboxylic acids which are used in preparing the overbased carboxylate include tall oil fatty acid, oleic, linoleic acid, and pumitic acids. Some preferred neutralizing agents include sodium hydroxide, calcium hydroxide and magnesium hydroxide. Statistical mixtures of overbased calcium carboxylates are believed to be particularly preferred.

After the overbased carboxylate has been formed it may be borated by reacting the carboxylate with a boron reactant. The boron reactant is preferably in the form of boric acid. In order to carry out the reaction boric acid is charged into the reaction medium containing the overbased carboxylate in an amount necessary in order to form the desired type of borate. Different amounts of $H_3BO_3$ may be charged into the system to obtain the desired amount of borate incorporation depending upon the desired end results and the particular functional fluid or lubricating compositions that the rust inhibitor is to be used in connection with.

Useful boron reactants include, boric acid, and various alkylborates such as tri-butylborate and sodium metaborate with boric acid being preferred. The overbased carboxylate can be completely or partially borated with one or more boron reactants.

The overbased carboxylate rust inhibitor in its borated and non borated versions may be present in a lubricating composition or functional fluid such as a gear oil in an amount sufficient to improve the rust inhibiting performance characteristics of the lubricant or fluid. This amount can be determined by those skilled in the art and varies depending on factors such as the type of oil base, the end use, and other additives present in the formulation. In general the rust inhibitor is present in an amount in the range of from about 0.1% to 3%, preferably from about 0.2% to about 1.5% and most preferably about 0.5% by weight based on the weight of a fully formulated lubricant or functional fluid.

The carboxylic acids from which suitable overbased salts for use in this invention can be made include aliphatic, cycloaliphatic, and aromatic mono- and polybasic carboxylic acids such as the napthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, a-linolenic acid, propylenetetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oil acids, rosin acids, and the like. It is preferably to use a statistical mixture of such acids containing 12 to 400 carbon atoms.

A typical group of oil-soluble carboxylic acids useful in preparing the salts used in the present invention are the oil-soluble aromatic carboxylic acids. These acids are represented by the general formula:

$$(R^*)_a-(Ar^*)-\left[\overset{X^*}{\overset{\|}{C}}-X^*H\right]_m \qquad \text{(IV)}$$

wherein R* is an aliphatic hydrocarbon-based group of at least 4 carbon atoms, and no more than about 400 aliphatic carbon atoms, a is an integer from one to four, Ar* is a polyvalent aromatic hydrocarbon nucleus of up to about 14 carbon atoms, each X* is independently a sulfur or oxygen atom, and m is an integer of from one to four with the proviso that R* and a are such that there is an average of at least 8 aliphatic carbon atoms provided by the R* groups for each acid molecule represented by Formula IV. Examples of aromatic nuclei represented by the variable Ar* are the polyvalent aromatic radicals derived from benzene, napthalene anthracene, phenanthrene, indene, fluorene, biphenyl, and the like. Generally, the radical represented by Ar* will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylaminophenylenes, chlorophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH—, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar* may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

The carboxylic acids corresponding to Formulae IV–V above are well known or can be prepared according to procedures known in the art. Carboxylic acids of the type illustrated by the above formulae and processes for preparing their overbased metal salts are well known and disclosed, for example, in such U.S. Pat. Nos. as 2,197,832; 2,197,835; 2,252,662; 2,252,664; 2,714,092; 3,410,798 and 3,595,791 which are incorporated by reference herein for their disclosures of acids and methods of preparing overbased salts.

The following examples are provided so as to provide those of ordinary skill in the art with a complete disclosure and description of how to make the overbased carboxylates, and lubricating formulations (gear oils) of the invention. Accordingly, the examples are not intended to limit the scope of what the inventor regards as his invention. Efforts have been made to ensure accuracy with respect to the numbers and nomenclature used (e.g. amounts, compounds, temperatures, etc.) but some experimental errors and deviation should be accounted for. Unless indicated otherwise, parts are parts by weight, temperature is in degrees centigrade and pressure is at or near atmospheric.

EXAMPLE A

Add to a flask about 512 parts by weight of a mineral oil solution containing about 0.5 equivalent of a substantially neutral magnesium salt of an alkylated salicylic acid wherein the alkyl group has an average of about 18 aliphatic carbon atoms and about 250 parts by weight of xylene. Heat to a temperature of about 60° C. to 70° C. Increase the heat to about 85° C. and add approximately 60 parts by weight of water. Hold the reaction mass at a reflux temperature of about 95° C. to 100° C. for about 1½ hours and subsequently strip at a temperature of 155° C.–160° C., under a vacuum, and filter. The filtrate will comprise the basic carboxylic magnesium salt containing 200% of the stoichiometrically equivalent amount of magnesium.

EXAMPLE B

Charge a reaction flask with about 506 parts by weight of a mineral oil solution containing about 0.5 equivalent of a substantially neutral magnesium salt of an alkylated salicylic acid wherein the alkyl groups have an average of about 16 to 24 aliphatic carbon atoms together with about 22 parts by weight (about 1.0 equivalent) of a magnesium oxide and about 250 parts by weight of xylene. Heat to a temperature of about 60° C. to 70° C. Increase the temperature to about 85° C. and add approximately 60 parts by weight of water to the reaction mass and heat to the reflux temperature. Maintain the reaction mass at the reflux temperature of about 95°–100° C. for about 1½ hours and subsequently strip at about 155° C., under 40 torr and filter. The filtrate comprise the basic carboxylic magnesium salts containing 274% of the stoichiometrically equivalent amount of magnesium.

EXAMPLE C

Prepare a substantially neutral magnesium salt of an alkylated salicylic acid wherein the alkyl groups have from 16 to 24 aliphatic carbon atoms by reacting approximately stoichiometric amounts of magnesium chloride with a substantially neutral potassium salt of the alkylated salicylic acid. Charge a flask with a reaction mass comprising approximately 6580 parts by weight of a mineral oil solution containing about 6.50 equivalents of the substantially neutral magnesium salt of the alkylated salicylic acid and about 388 parts by weight of an oil mixture containing about 0.48 equivalent of an alkylated benzenesulfonic acid together with approximately 285 parts by weight (14 equivalents) of a magnesium oxide and approximately 3252 parts by weight of xylene. Heat to a temperature of about 55° C. to 75° C. Increase the temperature to about 82° C. and add approximately 780 parts by weight of water to the reaction and then heat to the reflux temperature. Hold the reaction mass at the reflux temperature of about 95°–100° C. for about 1 hour and subsequently strip at a temperature of about 170° C., under 50 torr and filter. The filtrate will comprise the basic carboxylic magnesium salts and have a sulfated ash content of 15.7% (sulfated ash) corresponding to 276% of the stoichiometrically equivalent amount.

EXAMPLES A-1, B-1, C-1

Individual overbased carboxylates for any of EXAMPLES A–C or mixtures of carboxylates from all or any of A–C can be and preferably are borated by reacting with a suitable borating agent such as boric acid to provide EXAMPLES A-1, B-1, and C-1 respectively. The resulting borated carboxylate provides improved anti-rust properties in lubricants such as gear oils.

EXAMPLE 1

Prepare a gear oil formulation by starting with a base oil formulation utilized in making gear oils, specifically SAE 80W-90 (80% 600N+20% 150 Bright Stock). Add to the base oil composition 0.25% by weight of a borated overbased carboxylate obtained by reacting the overbased carboxylate of Example A with boric acid. Thereafter add a suitable pour point depressant, specifically the reaction product of a maleic anhydride/styrene copolymer with alcohol and an amine, the pour point depressant being added in an amount of 1 weight percent. Add 1% of an amine-neutralized phosphate ester and 0.075 weight percent of an oleamide/linoleamide mixture of hydroxyalkyl dialkyl-phosphorodithioate. Add 0.075 weight percent of polymeric anti-foaming agent and add 3.6% of a sulfurized olefin. Then add 0.08 weight percent of an ashless inhibitor commercially sold as Amoco 158.

EXAMPLE 2

Formulate a gear oil by starting with a base oil formulation utilized in making gear oils, specifically Exxon Base SAE 80W-90. Add to the base oil composition 0.25% by weight of an overbased carboxylate obtained by the procedure of Example A. Thereafter add 1% by weight of a pour point depressant (a maleic anhydride/styrene copolymer). Add 1% of an amine-neutralized phosphate ester and 0.75 weight percent of an oleamide/linoleamide mixture of hydroxyalkyl dialkyl-phosphorodithioate. Add 0.075 weight percent of a polymeric anti-foaming agent and add 3.6% of an sulfurized olefin as an antioxidant.

EXAMPLE 3

Prepare a gear oil formulation starting with Exxon Base SAE 80W-90. Add to the base oil composition 0.10% by weight of a borated overbased carboxylate obtained by reacting the overbased carboxylate of Example B with boric acid. Thereafter add a suitable pour point depressant, specifically the reaction product of a maleic anhydride/styrene copolymer with alcohol and an amine, the viscosity improver being added in an amount of 1 weight percent. Add 1% of an amine-neutralized phosphate ester. Add 0.075 weight percent of a polymeric anti-foaming agent and add 4.0% of an sulfurized olefin.

EXAMPLE 4

A gear oil formulation can be prepared by adding to a base oil of Exxon Base SAE 80W-90 3.0% by weight of a borated overbased carboxylate obtained by reacting the overbased carboxylate of Example C with boric acid. Thereafter add 1.0% by weight of a suitable pour point depressant and 1% of an amine-neutralized phosphate ester. Add 0.1% weight percent of a polymeric anti-foaming agent and add 2.0% of an sulfurized olefin. Then add 3.0 weight percent of an epoxide treated dialkylphosphorodithioate.

EXAMPLE 5

A gear oil formulation was prepared starting with SEA 80W-90 base oil which was comprised of 75% by weight of 600 neutral oil and 25% of 150 bright stock. To the base oil was added 1% by weight of pour point depressant in the form of a reaction product obtained by reacting a maleic anhydride/styrene copolymer with ethanol and an amine. An anti-wear agent (3% by weight) was added in the form of an epoxide treated dialkylphosphorodithioate. One weight % of borated, calcium carboxylate was added, 0.1 weight % of R-$NC_3H_6N$ (R is tallow) and 0.075 weight % of a polymeric anti-foam agent were added to complete the gear oil formulation having improved anti-corrosion properties.

EXAMPLE 6

A gear oil formulation was prepared starting with SEA 80W-90 base oil which was comprised of 75% by weight of 600 neutral oil and 25% of 150 bright stock. To the base oil was added 1% by weight of a reaction product obtained by reacting a maleic anhydride/styrene copolymer with ethanol and an amine as a viscosity index improver. An anti-wear agent (3% by weight) was added in the form of an epoxide treated dialkylphosphorodithioate. One weight % of calcium carboxylate was added, 0.1 weight % of R-$NC_3H_6N$ (R is tallow) and 0.075 weight % of a polymeric antifoam agent were added to complete the gear oil formulation having improved anti-corrosion properties.

EXAMPLE 7

A gear oil formulation was prepared starting with SEA 80W-90 base oil which was comprised of 75% by weight of 600 neutral oil and 25% of 150 bright stock. To the base oil was added 1% by weight of a reaction product obtained by reacting a maleic anhydride/styrene copolymer with ethanol and an amine as a viscosity index improver. A sulfurized olefin was added in an amount of 3% by weight. An anti-wear agent (3% by weight) was added in the form of an epoxide treated dialkylphosphorodithioate. One weight % of a borated calcium carboxylate was added, 0.2 weight % of R-$NC_3H_6N$ (R is tallow) and 0.075 weight % of a polymeric antifoam agent were added to complete the gear oil formulation having improved anti-corrosion properties.

COMPARATIVE EXAMPLE 1

This example was prepared in the same manner as Example 7 except that the 1 weight % of borated calcium carboxylate was not added to the formulation.

COMPARATIVE EXAMPLE 2

Another comparative example was prepared in the same manner followed within Example 7 except that 1 weight of calcium sulfonate was added to the formulation in place of the 1 weight % of calcium carboxylate added in Example 7.

COMPARATIVE EXAMPLE 3

Another comparative formulation was prepared in the same manner as Example 7 except that 1 weight % of an acidic rust inhibitor was added to the formulation in place of the borated calcium carboxylate of Example 7.

COMPARATIVE EXAMPLE 4

Another comparative formulation was prepared utilizing the same components put forth within Example 7 except that 1 weight % of an extra basic rust inhibitor was added to the formulation in place of the borated calcium carboxylate of Example 7.

The above examples show the use of SAE 80W-90 oil as the base oil. In preparing a gear oil SAE 80W-90 oil is preferred but 75W to about 140W oils may be used and may be used in combination with 150 bright stock oil. Base oils used in preparing gear oils are 200 neutral or above, preferably 300N or above and more preferably about 500N to 700N. The viscosity of a gear oil base oil is 40 cSt @ 40° C. or higher (6 cSt @ 100° C. or higher) preferably 60 cSt @ 40° C. or higher (8 cSt @ 100° C. or higher). These readings are well above those of base oils used as lubricants in a crankcase e.g., 5 W and 10W base oil of about 100N and about 20 cSt @ 40° C. (4 cSt @ 100° C.).

The gear oil formulations of the present invention typically include a suitable pour point depressant compound. The pour point depressant compound is generally present in an amount in the range of about 0.05% to 4%, more preferably 0.5% to 2% by weight based on the weight of the gear oil. A number of useful pour point depressant compositions are known and are used in oils and fuels in order to allow such to flow freely at lower temperatures. Such compounds may typically be comprised of the condensation product of a chlorinated paraffin and an aromatic hydrocarbon such as naphthalene. A large number of different pour point depressants and other publications disclosing pour point depressants are disclosed and described within PCT Publication No. US86/02792, published Aug. 30, 1987 (incorporated herein by reference for purposes of disclosing useful pour point depressant compositions).

Gear oil formulations of the present invention also typically include sulfurized olefin compounds which are useful as anti-oxidants. Such compounds are typically prepared by reacting unsaturated olefin compounds with sulfurizing agents such as hydrogen sulfide or elemental sulfur under particular reaction conditions and possibly in the presence of a catalyst. A number of sulfurized olefin compositions are disclosed within PCT Publication No. US86/00884 published Dec. 25, 1986 (incorporated herein by reference to disclose sulfurized olefin compounds).

The above-referred to PCT Publication also refers to a number of other patents and publications which disclose sulfurized olefin compositions and methods for making such. Such sulfurized olefin compounds may be present within a gear oil in an amount in the range of 0.5% to 10%, more preferably 1% to 5% and even more preferably in an amount of about 2% by weight based on the total weight of the gear oil.

The gear oil formulations of the present invention may also include therein extreme pressure - anti-wear agents. Such compounds may be in the form of coupled phosphorus containing amides. Such compounds are disclosed within issued U.S. Pat. No. 4,670,169 (incorporated herein by reference for disclosing phosphorus containing extreme pressure agents and methods for making such).

Gear oil formulations of the invention may also include other additives in minor amounts such as anti-foam agents which are used to reduce or prevent the formation of stable foam. Typical anti-foam agents include silicones or organic polymers. Additional anti-foam compositions are described in "Foam Control Agents", by Henry T. Kerner (Noyes Data Corporation, 1976), pages 125–162.

In addition to the amine/phosphate ester compounds which can be used within the gear oil formulations of the invention it is possible to use various phosphorodithioate compounds such as group II metal phosphorodithioates such as zinc dicyclohexyl phosphorodithioate and other similar compounds as disclosed within U.S. Pat. No. 4,670,169 (incorporated therein by reference for disclosing such phosphordithioate compounds).

In addition to the components referred to above it is possible to include within the gear oil formulation other additive components such as dispersants, detergents, anti-oxidants, anti-wear agents, extreme pressure agents, emulsifiers, demulsifiers, friction modifiers, other anti-rust agents and corrosion inhibitors, viscosity improvers, dyes and solvents to improve handleability. These components may be present in various amounts depending on the needs of the particular gear oil formulation final product.

Widely accepted standard tests are available for evaluating the ability of a material to prevent corrosion or rust. Two of the most widely known and accepted standardized tests are the L-33 Moisture Corrosion Test and the ASTM D 665 Turbine Oil Rust Test (American Standard Testing Material, Book D, No. 665). These tests were shown to be useful in connection with the evaluation of the above invention as compared with other gear oils containing rust and corrosion inhibitors outside the scope of the present invention.

The L-33 Moisture Corrosion Test will be described first. Moisture which accumulates in a differential assembly of a vehicle can create a severe rust problem. A Dana Model 30 hybrid rear axle assembly is used in a test specifically designed to evaluate corrosion resistance characteristics of gear lubricants. The lubricant capacity is 1.2 L (2½ pints). In order to run the test 29.6 $cm^3$ (one ounce) of distilled water is added to the lubricant to increase the severity of the test. The unit is motored at 2500 rpm for four hours at 82° C. (180° F.) lubricant temperature. After the motoring period, the assembly is stored for seven days at a temperature of 52° C. (125° F.). Following storage, the unit is disassembled and the cover plate, differential case, gear teeth and bearings are inspected for rust. In order to receive a "pass" in the L-33 Moisture Corrosion Test no rust is allowed on the gear teeth, bearings or any other functioning part of the rear axle assembly. It should be noted that the cover of the rear axle assembly is more susceptible to rust, and therefore may have no more than 1% of the surface rusted in order to receive a "pass" rating in accordance with the L-33 Moisture Corrosion Test. Accordingly, if there is rust on any of the functioning parts of the rear axle assembly or if there is rust on more than 1% of the surface of the cover, a "fail" rating is received. The L-33 Moisture Corrosion Test is part of the MII-L-2105C specification for gear lubricants, and is recognized worldwide as a standard for rust performance.

It is known that contamination of lubricants with water can produce rapid rusting of the ferrous parts unless the lubricants are adequately treated with an appropriate rust inhibiting agent. The ASTM D 665 Turbine Oil Rust Test is designed to measure the ability of industrial lubricants containing rust inhibitors to prevent rusting under conditions of water contamination.

The ASTM D 665 Test consists of two parts. One part of the test uses distilled water and the other part uses a synthetic sea water. Both tests are run under identical conditions and compared. The tests consist of stirring a mixture of 300 ml of the test lubricant with 30 ml of water at 60° (140° F.) for 24 hours. A special cylindrical steel test specimen made from #1018 cold finished carbon steel is completely immersed in the test fluid. At the conclusion of the 24 hour period, the specimen is removed, washed with a solvent and rated for rust.

In order to receive a "pass" in accordance with the ASTM D 665 Turbine Oil Rust Test, the specimen must be completely free of visible rust when examined under magnification under normal light. When rust is observed the tested lubricant receives a "fail" rating.

The L-33 Moisture Corrosion Test as well as the ASTM D 665 Turbine Oil Test were run on lubricants encompassed the present invention. For comparison purposes the same lubricants which did not include the essential components of the present invention were also tested by the above described standard tests. The results are as follows:

| Formulation | Test | Rating |
|---|---|---|
| EXAMPLE 7 | L33 | Pass |
| | D665 | Pass |
| COM EX 1 | L33 | Fail |
| | D665 | Fail |
| COM EX 2 | L33 | Fail |
| | D665 | Fail |
| COM EX 3 | L33 | Fail |
| | D665 | Fail |
| COM EX 4 | L33 | Fail |
| | D655 | Fail |

In that comparative Examples 1–4 were the same as Example 7 but for changes regarding the carboxylate components it is believed that these results clearly demonstrate the importance of the present invention regarding the prevention of rust.

The instant invention is shown and described herein in what is considered to be the most practical, and preferred, embodiments. It is recognized, however, that departures may be made therefrom which are within the scope of the invention, and that obvious modifications will occur to one skilled in the art upon reading this disclosure.

What is claimed is:

1. A gear oil formulation, comprising:
a major amount of a base oil having a viscosity at 40° C. of 40 cSt or more;
an overbased carboxylate; and
a sulfurized olefin.

2. The gear oil formulation as claimed in claim 1, wherein the overbased carboxylate is borated.

3. The gear oil formulation as claimed in claim 2, wherein the overbased carboxylate is obtained by reacting a carboxylic acid containing from 12 to 22 carbon atoms, with a neutralizing agent containing a metal selected from the group consisting of calcium, sodium, and magnesium.

4. The gear oil formulation as claimed in claim 3, wherein the overbased carboxylate is present in an amount in the range of 0.1% to about 3% by weight based on the weight of the gear oil and the carboxylic acid is selected from the group consisting of tall oil fatty acid, oleic acid, linoleic acid, pumitic acid, stearic acid and lauric acid.

5. The gear oil formulation as claimed in claim 4, wherein the overbased carboxylate is present in an amount in the range of 0.2% to about 1.5% by weight based on the weight of the gear oil.

6. The gear oil formulation as claimed in claim 2, further comprising:
a pour point depressant;
an anti-foaming agent; and
an anti-wear agent.

7. A gear oil formulation comprising:
a major amount of a base oil having a viscosity of 40 c St or more at 40° C.;
a mixture of overbased carboxylate salts formed by reacting a carboxylic acid represented by general formula (IV):

$$(R^*)_a-(Ar^*)-(\overset{\overset{X^*}{\|}}{C}-X^*H)_m \qquad \text{(IV)}$$

wherein R* is an aliphatic hydrocarbon-based group of at least 4 carbon atoms, and no more than about 400 aliphatic carbon atoms, a is an integer from one to four, Ar* is a polyvalent aromatic hydrocarbon nucleus of up to about 14 carbon atoms, each X* is independently a sulfur or oxygen atom, and m is an integer of from one to four with the proviso that R* and a are such that there is an average of at least 8 aliphatic carbon atoms provided by the R* groups for each acid molecule represented by formula IV, with a stoichiometric excess of a neutralizing agent containing a metal selected from the group consisting of calcium, sodium and magnesium; and
a sulfurized olefin.

8. The gear oil formulation as claimed in claim 7, wherein the overbased carboxylate is present in an amount in the range of 0.1% to about 3% by weight based on the weight of the gear oil.

9. The gear oil formulation as claimed in claim 8, wherein the overbased carboxylate is present in an amount in the range of 0.2% to about 1.5% by weight based on the weight of the gear oil.

10. The gear oil formulation as claimed in claim 7, wherein the mixture of overbased carboxylate salts is reacted with a borating agent in order to form a mixture of borated overbased carboxylate salts.

11. The gear oil formulation as claimed in claim 10, wherein the borating agent is boric acid.

12. The gear oil formulation as claimed in claim 11, wherein the mixture of borated overbased carboxylate salts is present in an amount in the range of 0.1% to about 3% by weight based on the weight of the gear oil.

13. The gear oil formulation as claimed in claim 12, wherein the mixture of borated overbased carboxylate salts is present in an amount in the range of 0.2% to about 1.5% by weight based on the weight of the gear oil.

14. A method of improving the corrosion resistance of a gear oil formulation comprised of a major amount of a base oil having a viscosity of 40 c St or more @ 40° C. and 0.1 to 5% by weight based on the weight of the gear oil formulation of contaminant water, comprising:
adding to the gear oil formulation 0.1 to 3% by weight of an overbased carboxylate; and
mixing the carboxylate throughout the oil in order to improve the corrosion resistance of the gear oil.

15. The method as claimed in claim 14, wherein the overbased carboxylate is a statistical mixture of overbased carboxylate salts formed by reacting a carboxylic acid represented by general formula (IV):

$$(R^*)_a-(Ar^*)-(\overset{\overset{X^*}{\|}}{C}-X^*H)_m \qquad \text{(IV)}$$

wherein R* is an aliphatic hydrocarbon-based group of at least 4 carbon atoms, and no more than about 400 aliphatic carbon atoms, a is an integer from one to four, Ar* is a polyvalent aromatic hydrocarbon nucleus of up to about 14 carbon atoms, each X* is independently a sulfur or oxygen atom, and m is an integer of from one to four with the proviso that R* and a are such that there is an average of at least 8 aliphatic carbon atoms provided by the R* groups for each acid molecule represented by formula IV, with a stoichiometric excess of a neutralizing agent containing a metal selected from the group consisting of calcium, sodium and magnesium.

16. The method as claimed in claim 15, wherein the mixture of overbased carboxylate salts is a mixture of borated overbased carboxylate salts formed by reacting the mixture of overbased carboxylate salts with a borating agent.

17. The method as claimed in claim 16, wherein the borating agent is boric acid.

18. The method as claimed in claim 17, wherein the mixture of borated overbased carboxylate salts is added in an amount in the range of 0.2% to 1.5% by weight based on the weight of the gear oil.

* * * * *